US006676375B2

(12) United States Patent
Steeves LeBlanc et al.

(10) Patent No.: US 6,676,375 B2
(45) Date of Patent: Jan. 13, 2004

(54) CHANDELIER ADAPTOR FOR CEILING FAN

(76) Inventors: Ellen Holmes Steeves LeBlanc, 709 Ireland Ct., Jacksonville, NC (US) 28546; Kenneth W. Steeves, 25 Dean Dr., South Glastonbury, CT (US) 06073

( * ) Notice: Subject to any disclaimer, the term of this patent is extended or adjusted under 35 U.S.C. 154(b) by 0 days.

(21) Appl. No.: 10/213,445

(22) Filed: Aug. 7, 2002

(65) Prior Publication Data

US 2003/0063977 A1 Apr. 3, 2003

Related U.S. Application Data

(60) Provisional application No. 60/310,671, filed on Aug. 8, 2001.

(51) Int. Cl.[7] ..... F04D 29/64

(52) U.S. Cl. ..... 416/5; 416/244 R; 362/406

(58) Field of Search ..... 416/5, 244 R; 248/344; 362/406, 149, 96, 405, 407, 404

(56) References Cited

U.S. PATENT DOCUMENTS

| | | | | |
|---|---|---|---|---|
| 2,581,185 A | | 1/1952 | Gordon | 230/249.5 |
| 3,621,113 A | * | 11/1971 | Westby | 174/51 |
| 4,303,968 A | | 12/1981 | Goralnik | 362/147 |
| 4,342,073 A | | 7/1982 | Ranten | 362/294 |
| 4,382,400 A | | 5/1983 | Stutzman | 98/40 DL |
| 4,402,649 A | | 9/1983 | Laurel | 416/5 |
| 4,531,179 A | * | 7/1985 | Baker | 362/371 |
| 4,655,531 A | | 4/1987 | Delaney | 339/135 |
| D298,454 S | | 11/1988 | Clyde-Mason | D23/385 |
| 4,796,166 A | | 1/1989 | Greenberg | 362/96 |
| 4,831,505 A | | 5/1989 | Van Norman | 362/216 |
| D312,139 S | | 11/1990 | Wang | D26/51 |
| D312,687 S | | 12/1990 | Mason et al. | D23/377 |
| 5,028,206 A | | 7/1991 | Kendregan et al. | 416/5 |
| 5,072,341 A | | 12/1991 | Huang | 362/96 |
| 5,097,398 A | | 3/1992 | Dye | 362/147 |
| 6,116,559 A | | 9/2000 | Lackey | 248/343 |

* cited by examiner

*Primary Examiner*—Edward K. Look
*Assistant Examiner*—Kimya N McCoy
(74) *Attorney, Agent, or Firm*—Jim Zegeer

(57) ABSTRACT

A ceiling fan and pendent chandelier wherein the ceiling fan is provided with a chandelier adaptor which adapts the ceiling fan to hang a pendent chandelier therefrom.

13 Claims, 14 Drawing Sheets

CHANDELIER ADAPTOR FOR CEILING FAN

REFERENCE TO RELATED APPLICATION

The present application is the subject of provisional application Ser. No. 60/310,671 filed Aug. 8, 2001 entitled CHANDELIER ADAPTOR FOR CEILING FAN which is incorporated herein by reference.

BACKGROUND AND BRIEF DESCRIPTION OF THE INVENTION

The present invention is in the field of ceiling fans provided with pendent chandelier lighting. More particularly, it is directed to ceiling fans provided with pendent chandelier lighting and an adaptor for coupling the pendent chandelier lighting to the ceiling fan.

Certain ceiling fans are manufactured with the ability to mount a lighting fixture. These lighting fixtures are attached by a rigid connection to the bottom of the ceiling fan switch box or housing. The lighting fixtures are usually manufactured by the fan manufacturer. Thus, the choice of types and styles of lighting fixtures is therefore limited.

Ceiling fans with associated illumination and lighting means are disclosed in the following U.S. patents:

| Pat. No. - Inventor | |
|---|---|
| 2,581,185 | Gordon |
| 4,342,073 | Ranten |
| 4,382,400 | Stutzman |
| 4,402,649 | Laurel |
| 4,796,166 | Greenberg |
| 4,831,505 | Van Norman |
| 5,028,206 | Kendregan et al |
| 5,072,341 | Huang |
| Des. 298,454 | Clyde-Mason |
| Des. 312,139 | Wang |
| Des. 312,687 | Mason et al |

None of the above patents discloses ceiling or overhead fans with pendent chandelier lighting.

This invention incorporates a chandelier adaptor which will allow all types of pendent chandeliers to be attached and suspended from a ceiling fan in a similar manner as they are presently attached to the ceiling itself. The invention provides a means to allow pendent chandeliers to be attached by means of a flexible connection or suspension means. Typically, this flexible connection is by means of a chain, cord, cable, rod, etc. The chandelier adaptor can either be built into the ceiling fan during manufacture or added to the ceiling fan by using a modification kit after the ceiling fan is manufactured and/or installed.

This invention will allow the installation of a combined fixture to be installed in areas of a building where, up to this point in time, only a fan or a pendent chandelier could be utilized.

Thus, the object of the invention is to provide a ceiling fan and pendent chandelier with a ceiling fan adaptor for suspending the pendent chandelier from the ceiling fan.

Another object of the invention is to provide an adaptor for ceiling fans which enables the ceiling fan to support chandeliers and thus enhance the use of the fan and chandelier.

The invention features a ceiling fan and a pendent chandelier wherein the pendent chandelier has an elongated suspension member. The elongated suspension member has an upper end, a lower end, and an adaptor member. The adaptor member is secured to the ceiling fan and has one or more rings at the bottom thereof and a chandelier wiring passage therethrough. The upper end of the elongated suspension member is secured to the adaptor member and the lower end of the elongated suspension member is secured to the chandelier. The ceiling fan has a stationary axial member and the adaptor member is secured to the stationary axial member. The adaptor is constructed in such a manner to allow the center thereof to be hollow for the passage of electrical wiring to the pendent chandelier.

The invention also features a chandelier adaptor for adapting a ceiling fan to hang a pendent chandelier therefrom including a body member having an upper end adapted to be secured to a stationary portion of the ceiling fan and a lower end having one or more integral rings thereon for flexibly coupling the chandelier thereto.

The chandelier adaptor has its upper end internally threaded for screwing onto the end of the stationary switch box mounting shaft of an existing fan.

The chandelier adaptor may include a replacement switch box cover adapted to be secured to an existing switch box.

The invention also features a chandelier adaptor for adapting a ceiling fan to hang a pendent chandelier therefrom. The ceiling fan has a switch box on the lower end thereof and a cover secured thereto. The adaptor includes a body member having an upper end adapted to be secured to the switch box and one or more integral rings thereon for coupling the chandelier thereto.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
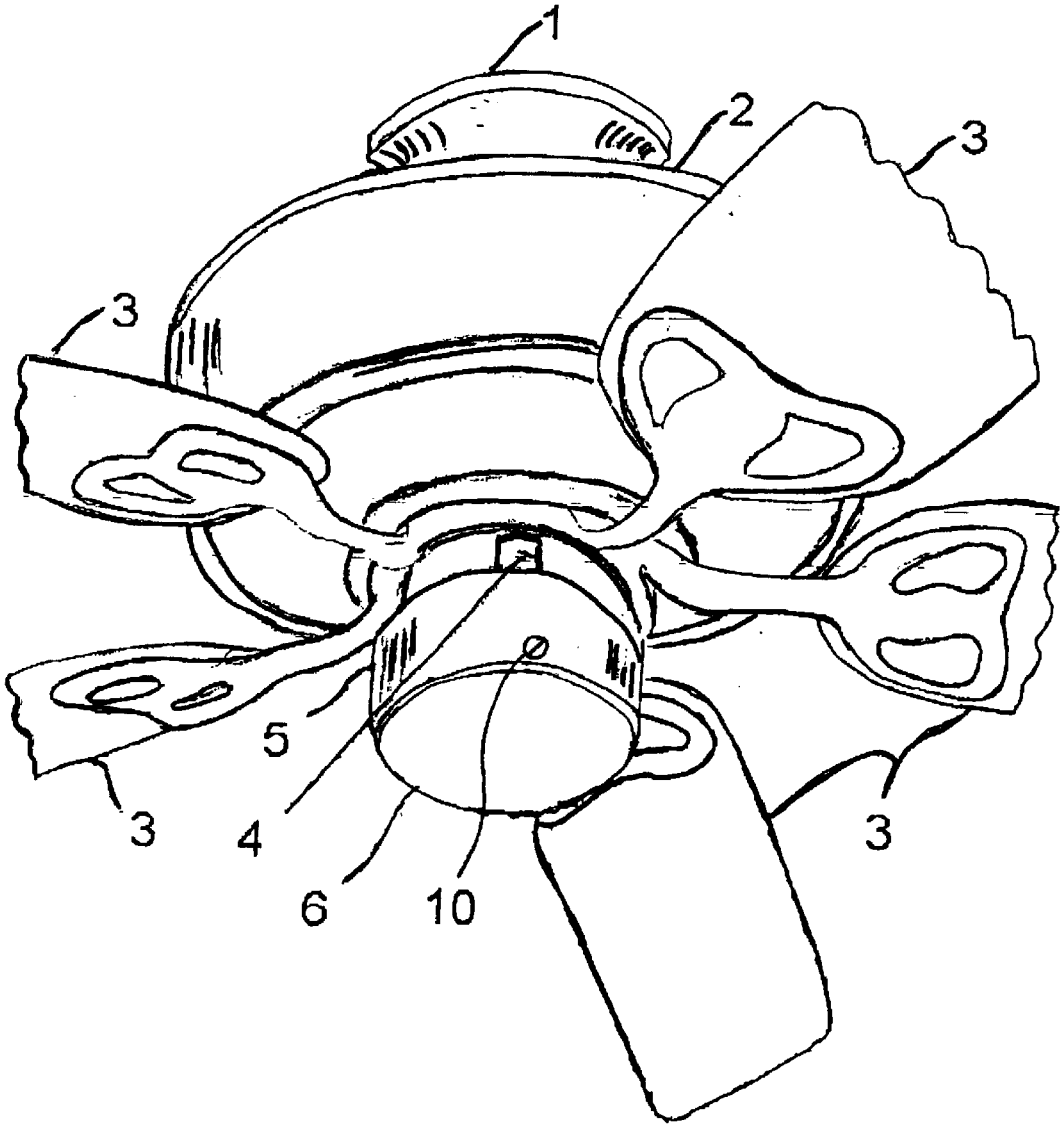
FIG. 1 (Prior Art)
FIG. 1 shows a typical ceiling fan without a lighting fixture.

FIG. 1 shows a typical ceiling fan without a lighting fixture. A typical ceiling fan assembly comprises (beginning at the top) a mounting means 1, a motor housing 2, the rotating fan blades 3, a hollow switch box mounting stem 4, and a switch box 5 where electrical switches are mounted to control the fan and lights. The switch box 5 is enclosed by a cover 6 on the bottom that is held in place by screws 10. It will be appreciated that the invention applies to remote control ceiling fan units.

Figure 2:
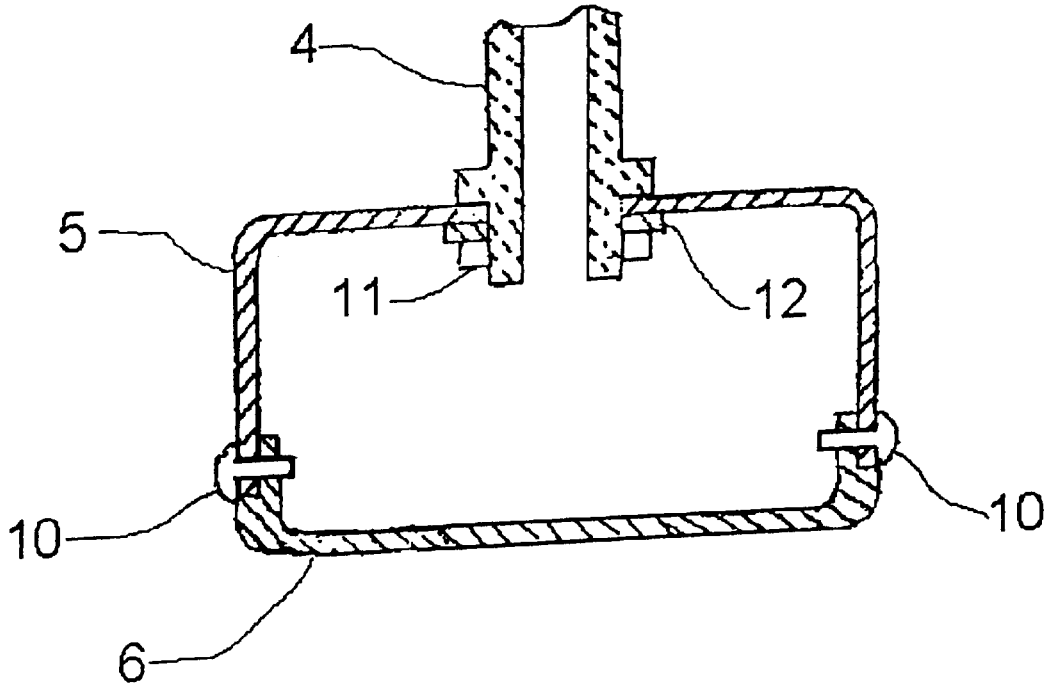
FIG. 2 (Prior Art)
FIG. 2 shows a cross-section of a typical ceiling fan switch box mounted on a hollow mounting stem, without a lighting fixture.

FIG. 2 shows a cross-section of a typical ceiling fan without a lighting fixture. The switch box 5 is typically attached to the end of the stationary threaded switch box mounting shaft 4 by means of a washer 12 and nut 11. The stem of shaft 4 is hollow to allow the passage of the electrical wiring to the switch box 5. Currently, when lighting fixtures are installed with the fan, the cover is removed and the light is rigidly attached to the switch box 5 using the screws 10.

Figure 3:
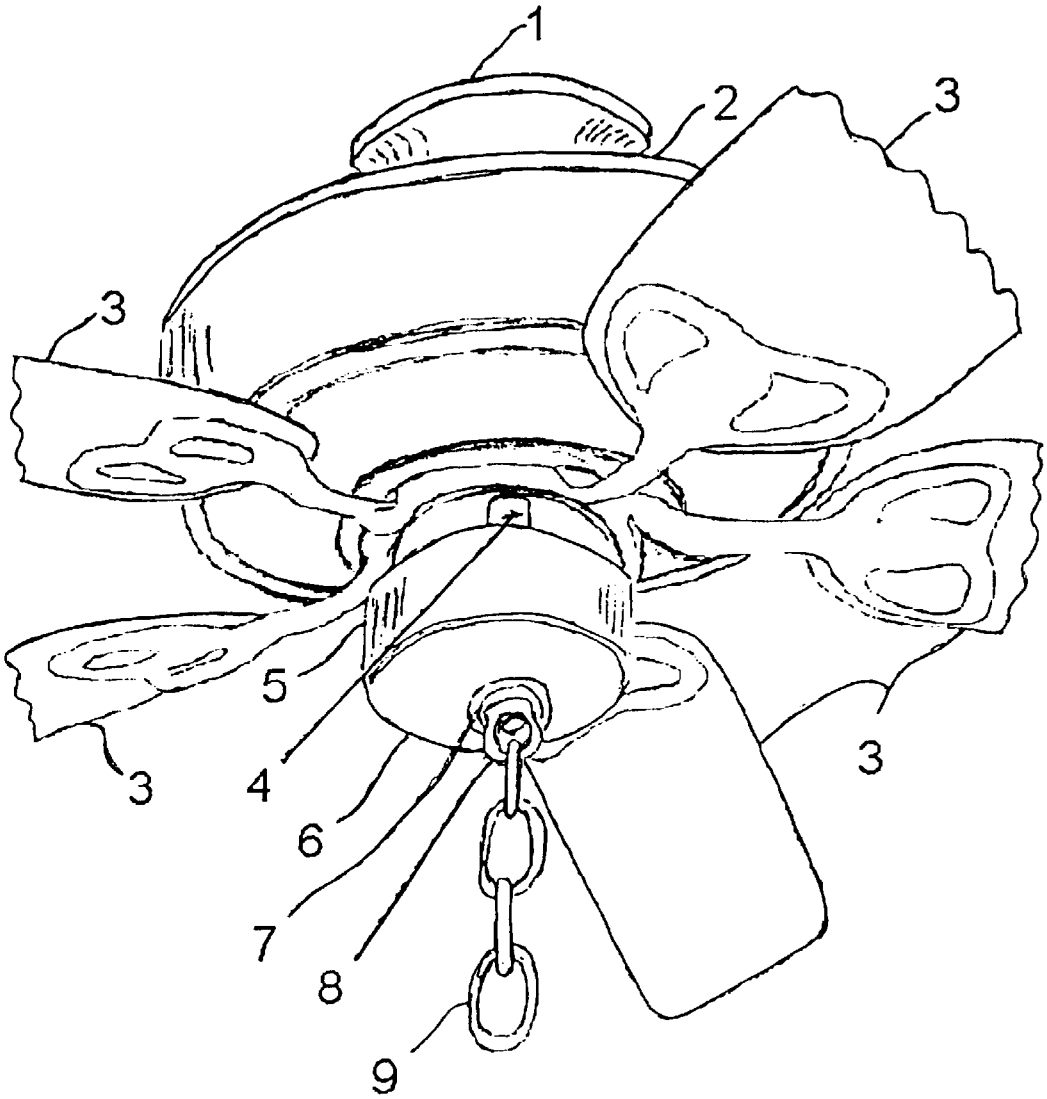
FIG. 3 is an illustration of a ceiling fan with the chandelier adaptor installed according to the invention.

FIG. 3 shows the ceiling fan with the chandelier adaptor 8 installed with a typical chandelier chain 9 attached.

The chandelier adaptor 8 can be one piece or made up of several parts similar to the embodiments shown in FIGS. 4, 4A, 4B 5, 10, 11 or 12. Depending upon construction of the chandelier adaptor 8, it can be installed by using the same screws 10 that hold the cover 6 onto the switch housing 5 or attached directly to the switch box mounting shaft 4. The chandelier adaptor 8 is constructed in such a way as to allow the wiring to continue to pass from the shaft 4 into the switch box 5 and allow the wiring for the chandelier to pass through into the switch box 5. Note that switch mounting shaft or stem 4 is mounted to the stationary fan motor frame and is axially stationary.

Figure 4:
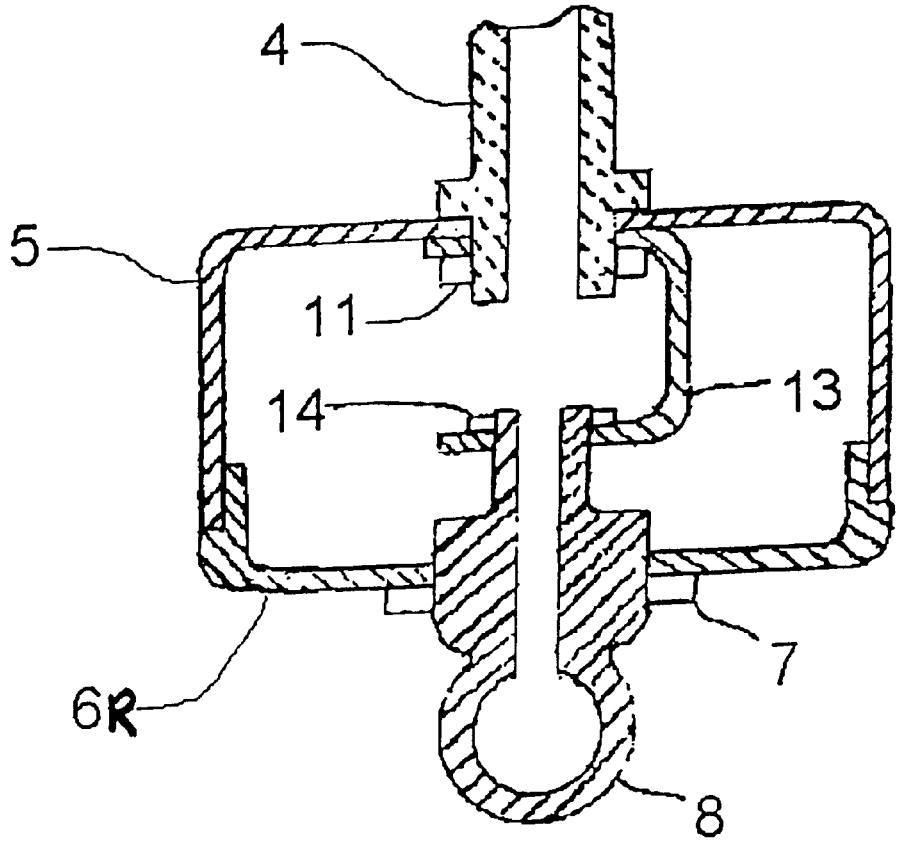
FIG. 4 shows a multi-part chandelier adaptor that is attached to the stationary switch box mounting stem of the fan according to the invention.

FIG. 4 shows a multi-part chandelier adaptor that is attached to the switch box mounting shaft 4.

As is the case with any installation of electrical equipment, all electricity is removed and disconnected from the unit prior to beginning the installation. The multi-part chandelier adaptor 8 is installed by removing the cover 6 and disconnecting the electrical wires for the fan switches that pass through the hollow shaft 4 to allow removal of the washer 12 and nut 11 which holds the switch box to the switch box mounting shaft 4. The chandelier adaptor bracket 13 is slipped over the shaft 4 and the nut 11 is replaced. The electrical wiring is then reconnected in the same manner as it was before it was disconnected. The chandelier adaptor 8 is screwed into the bracket and held in place with a threaded nut 14. The chandelier is then attached to chandelier adaptor 8 by a suspension means, such as chain 9, cable, wire or rod. The chandelier wiring is then connected to the wiring in the switch box. A replacement cover 6R to match the finish of the chandelier is slipped over the chandelier adaptor and held in place with a threaded nut 7.

Figure 4A:
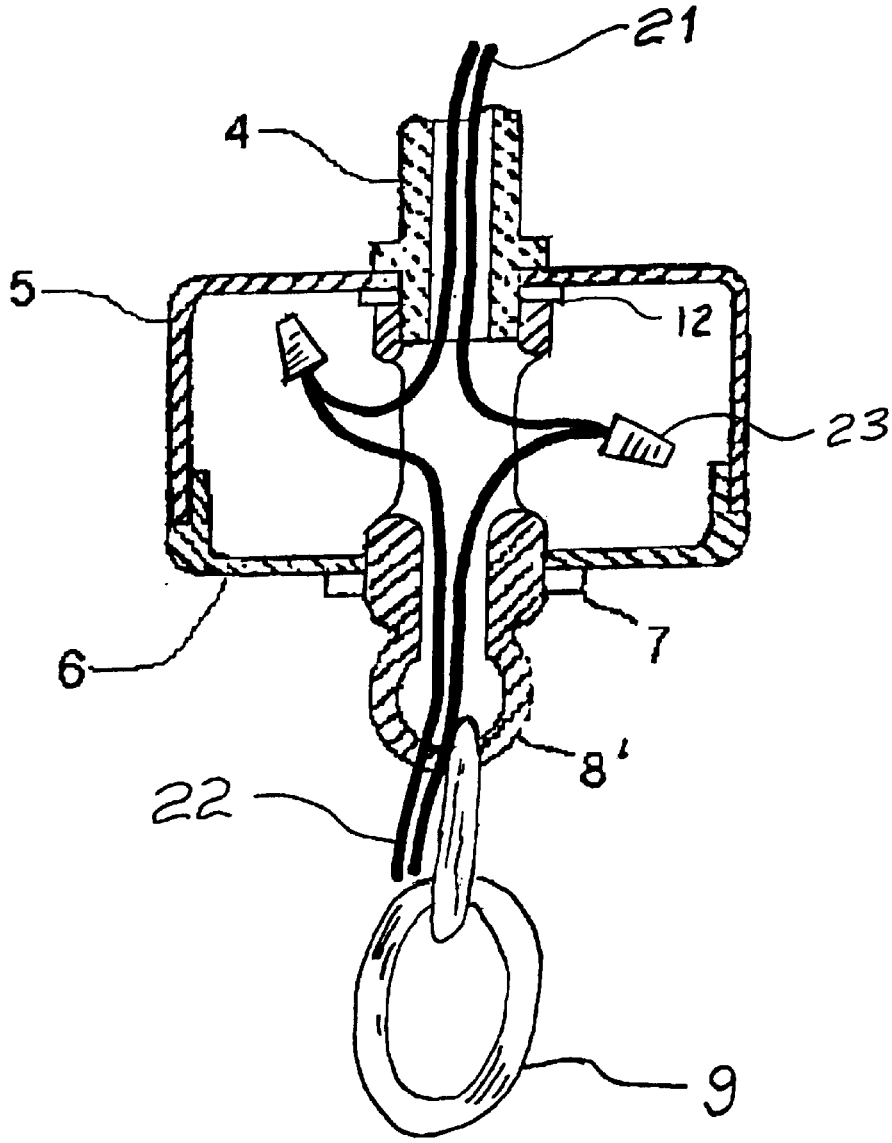
FIG. 4A shows a one-piece chandelier adaptor as attached to the stationary switch box mounting stem of the fan according to the invention.
Figure 10:
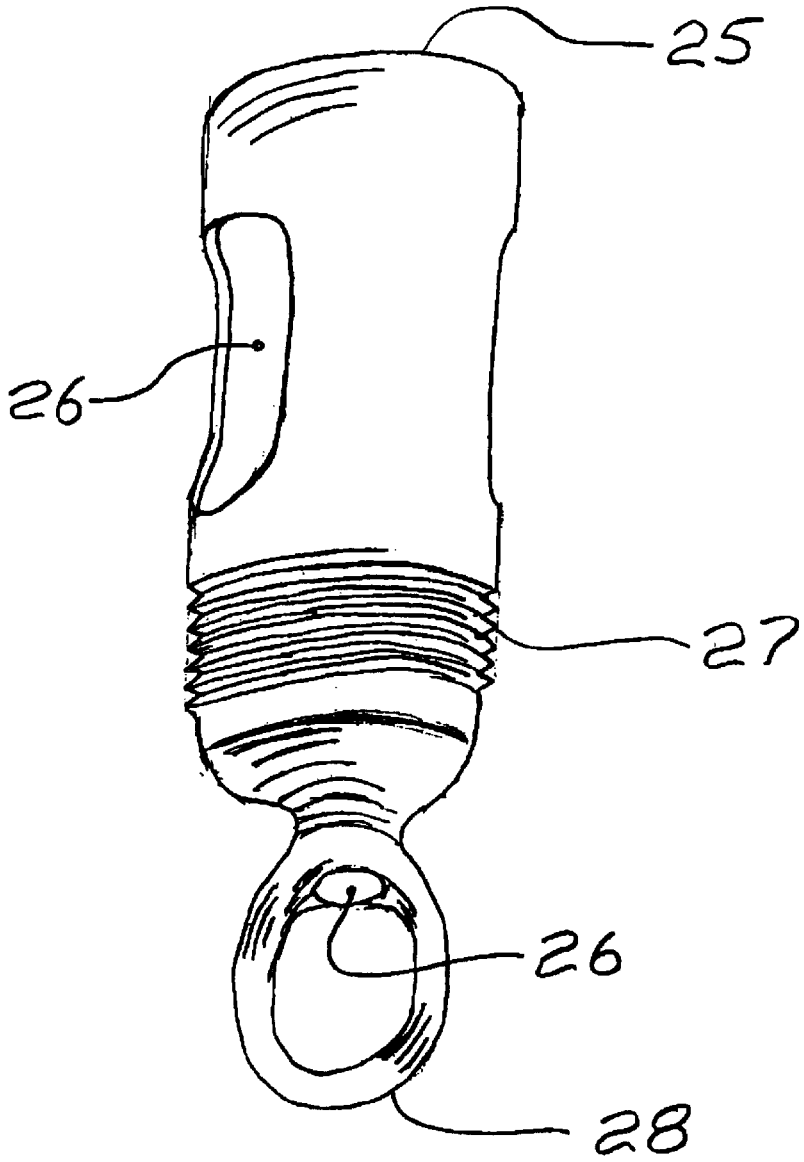
FIG. 10 illustrates a one-piece chandelier adaptor incorporating the invention.

FIGS. 4A and 10 shows an embodiment of a one-piece chandelier adaptor 8' that is attached to the switch box mounting stem or shaft 4. The chandelier adaptor 8' is constructed in such a manner to allow the center of the chandelier adaptor 8' to be hollow to permit the passage of the electrical wiring. It is installed by removing the original cover 6 and disconnecting the electrical wires for the fan switches that pass through the hollow shaft 4 to allow removal of the nut 11 which holds the switch box to the switch box mounting shaft 4. The chandelier adaptor 8' is screwed to the shaft 4. The electrical wiring for the fan is then reconnected in the same manner as it was before it was disconnected. The chandelier is then attached to chandelier adaptor 8' by a suspension means, such as chain 9, cable, wire or rod. The chandelier wiring 22 is then connected to the electrical wiring 21 by means of standard wire connectors 23 in the switch box. A replacement cover 6R to match the finish of the chandelier is slipped over the chandelier adaptor and held in place with a nut 7.

Figure 4B:
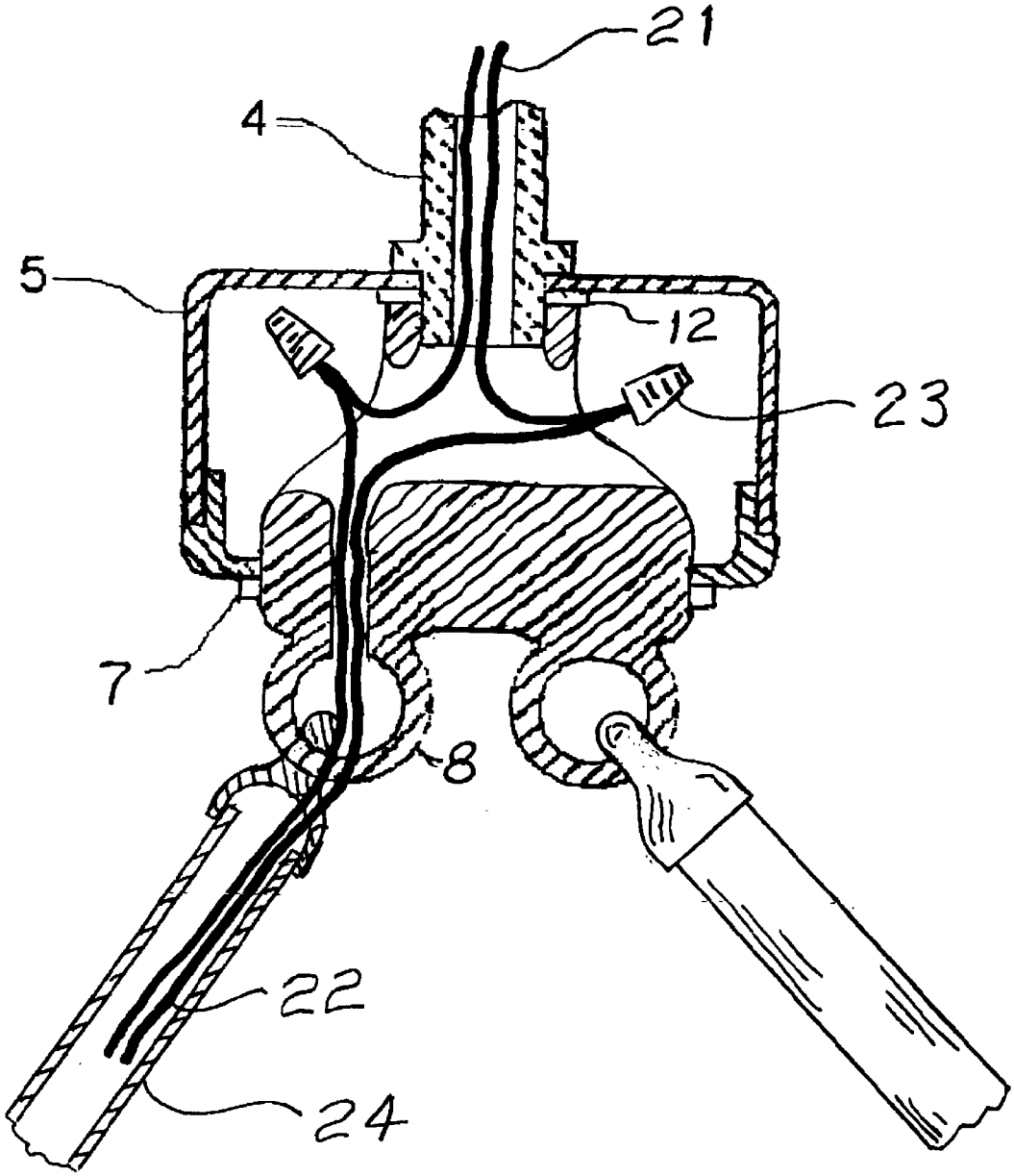
FIG. 4B is another adaptation of the one-piece channel adaptor as attached to the switch box mounting stem according to the invention.
Figure 11:
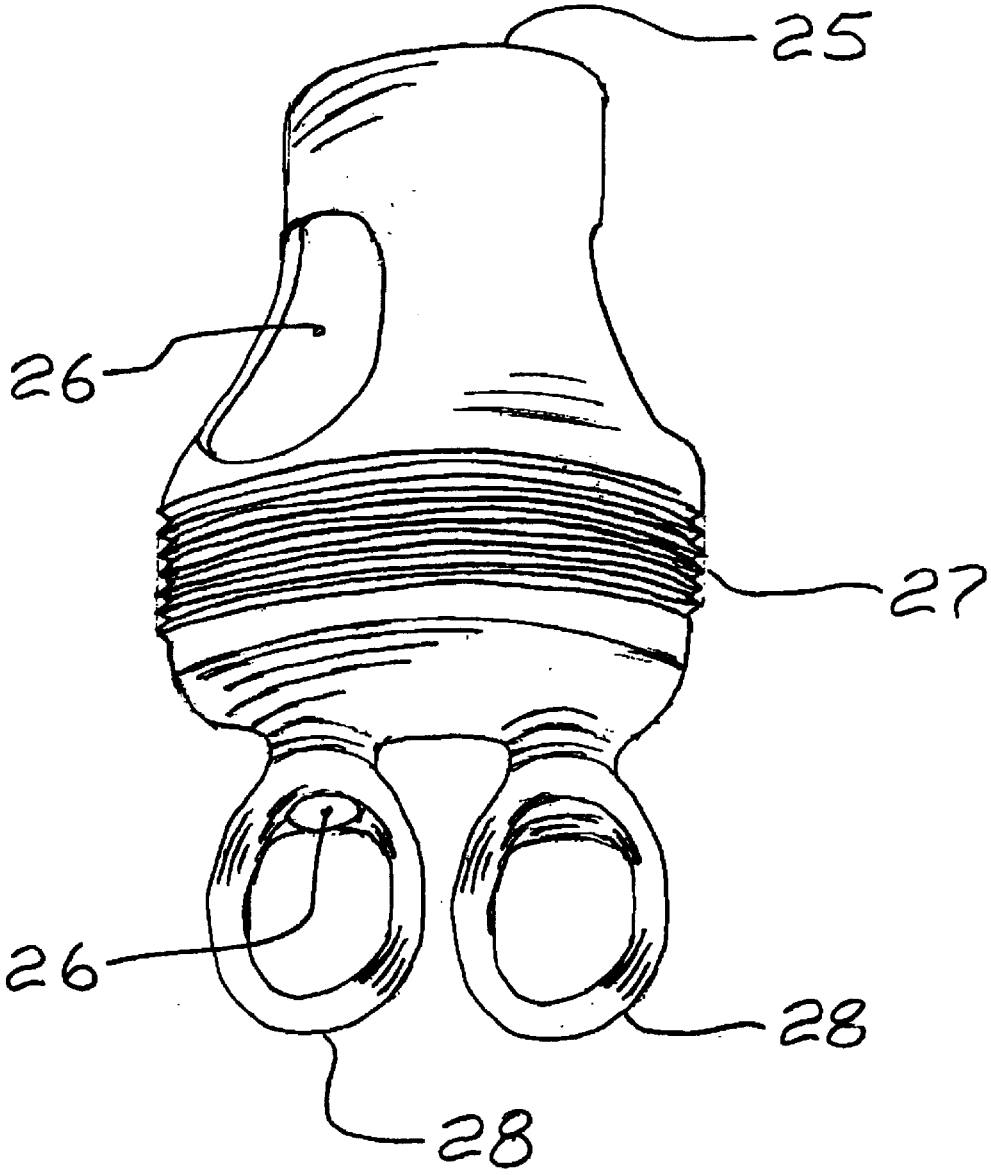
FIG. 11 is a one-piece chandelier adaptor that allows multiple attachment points for a chandelier according to the invention.

FIGS. 4B and 11 shows another one-piece chandelier adaptor 8" that is attached to the stationary switch box mounting shaft 4. This is a multiple connection type of chandelier adaptor to allow the use of chandeliers that have two or more mounting means. The chandelier adaptor is constructed in such a manner to allow the center of the chandelier adaptor to be hollow to permit the passage of the electrical wiring. It is installed by removing the original cover 6 and disconnecting the electrical wires for the fan switches that pass through the hollow shaft 4 to allow removal of the nut 11 which holds the switch box to the switch box mounting shaft 4. The chandelier adaptor 8" is screwed to the shaft 4. The electrical wiring of the fan is then reconnected in the same manner as it was before it was disconnected. The chandelier is then attached to chandelier adaptor 8", by flexible hollow rods 24 (or other suspension means such as chain, cable or wire). The chandelier wiring 22 is then connected to the electrical wiring 21 by means of standard wire connectors 23 in the switch housing or box 5. A replacement cover 6R" to match the finish of the chandelier is slipped over the chandelier adaptor and held in place with the nuts 7.

Figure 5:
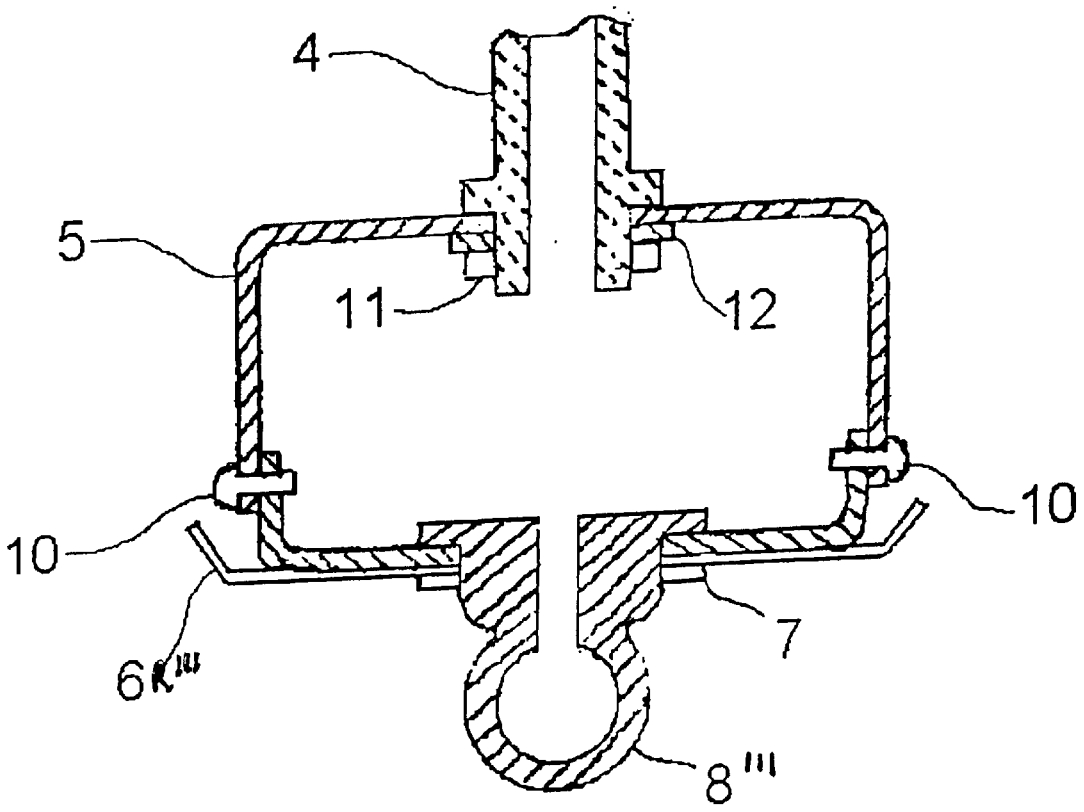
FIG. 5 shows another embodiment of a chandelier adaptor according to the invention that is attached to a switch housing according to the invention.

FIG. 5 shows a chandelier adaptor 8'" that is attached to the switch housing 5 using the cover screws 10. It is installed by removing the cover 6. The chandelier adaptor is inserted into the switch box 5 and the screws 10 are reinstalled. The chandelier wiring (not shown) is connected to wiring in the switch box. A replacement cover 6R'" to match the finish of the chandelier is slipped over the chandelier adaptor and held in place with nut 7.

Figure 6:
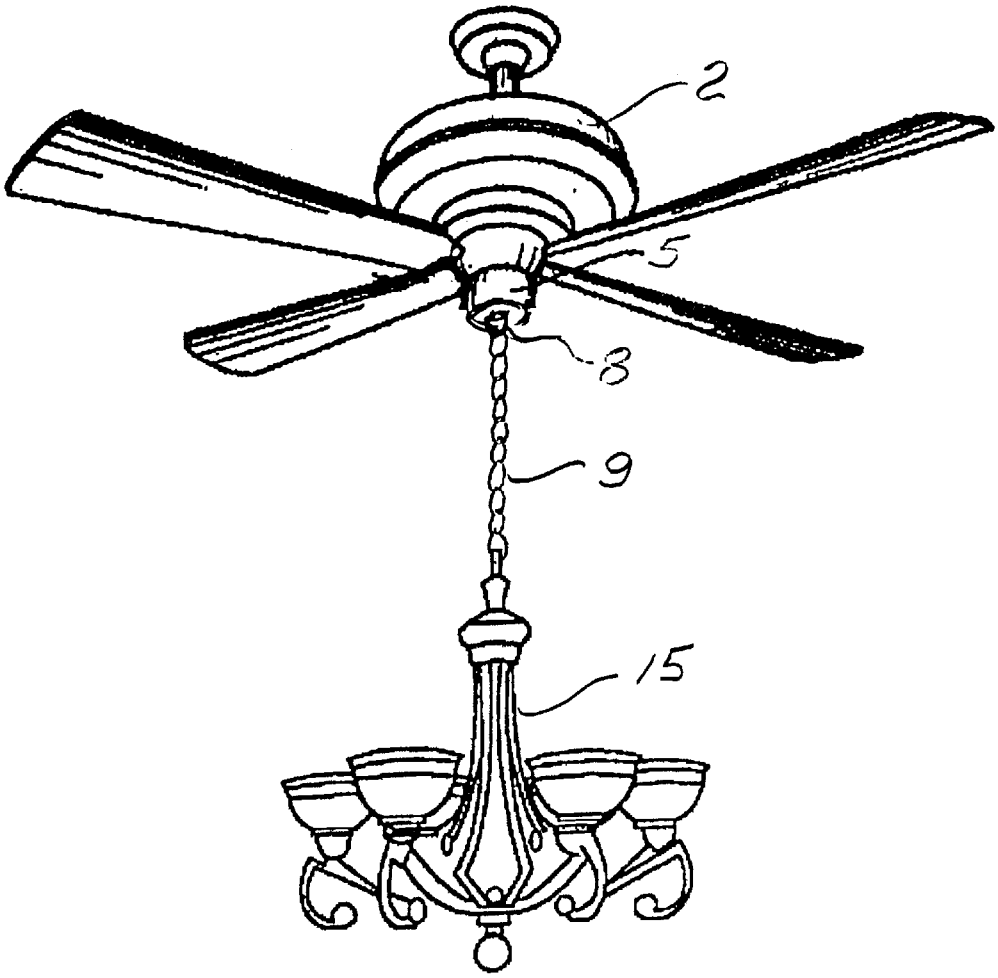
FIG. 6 shows a typical ceiling fan with a chandelier adaptor extending from the bottom of the switch housing and a chandelier.

FIG. 6 shows a typical ceiling fan 2 with the chandelier adaptor 8 extending out of the bottom of the switch housing 5. A typical chandelier 15 is mounted to the chandelier adaptor 8 by means of a decorative chain 9.

Figure 7:
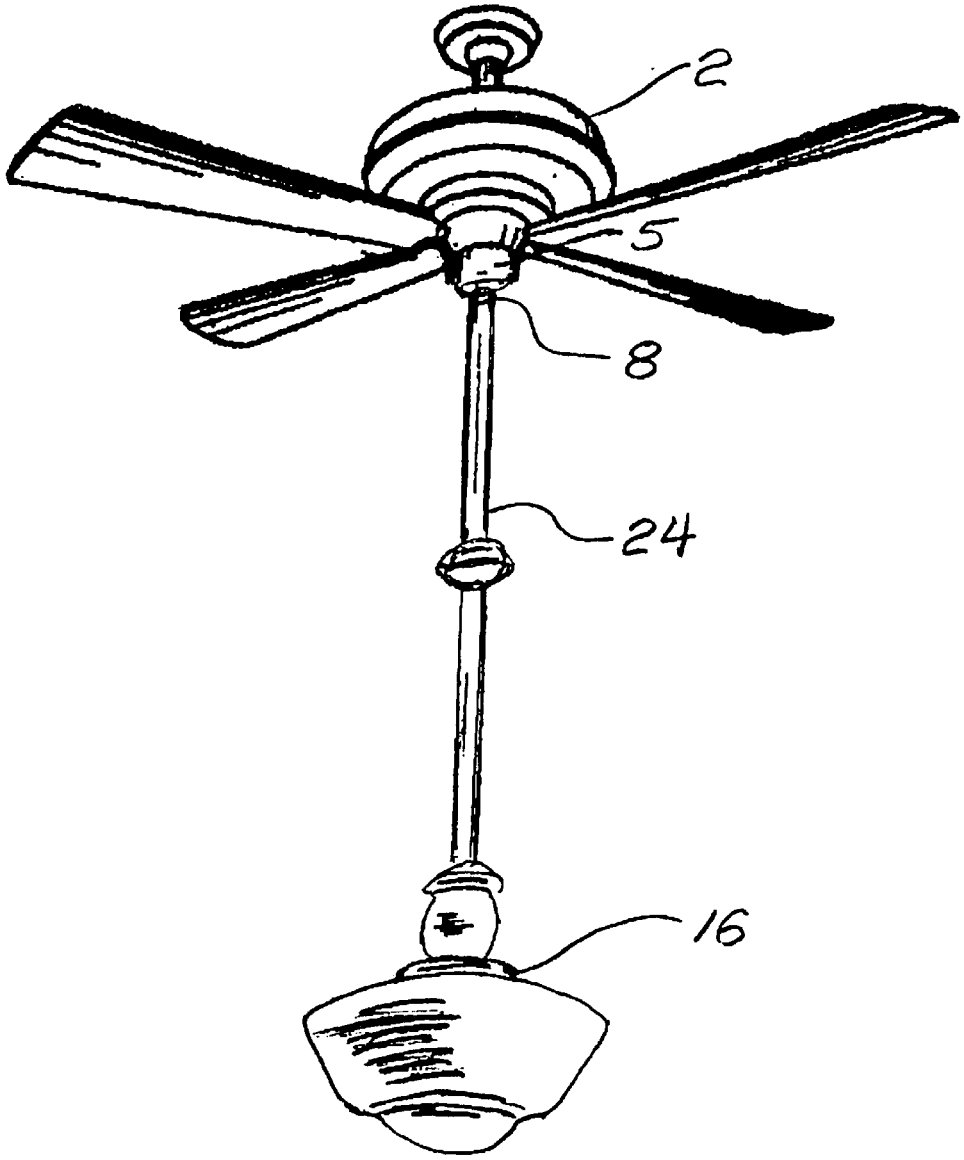
FIG. 7 shows a typical ceiling fan with a chandelier adaptor, according to the invention, extending out of the switch housing and a chandelier.

FIG. 7 shows a typical ceiling fan 2 with the chandelier adaptor 9 extending out of bottom of the switch housing 5. A typical pendent type of lighting fixture 16 is mounted to the chandelier adaptor 8 by means of a rod 24.

Figure 8:
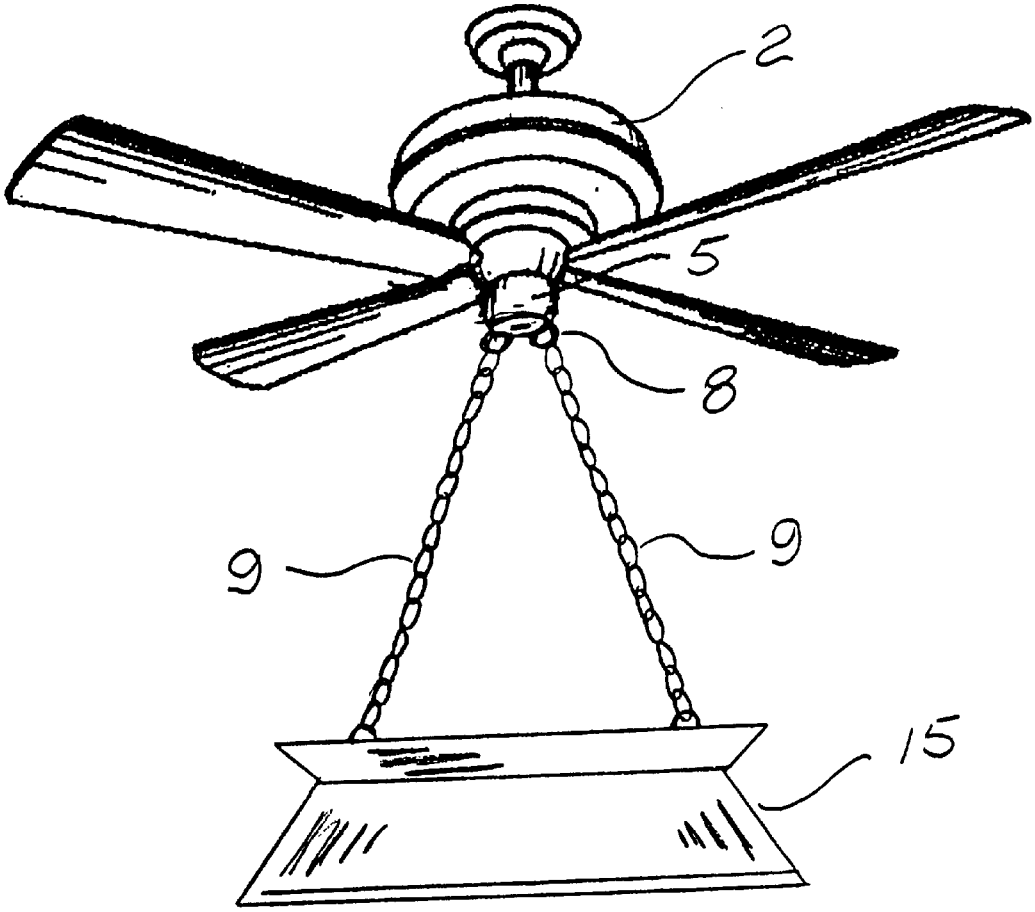
FIG. 8 is an illustration of a typical ceiling fan with the chandelier adaptor extending from the bottom of the switch housing and a chandelier.

FIG. 8 shows a typical ceiling fan 2 with the chandelier adaptor 8 extending out of the bottom of the switch housing 5. A typical chandelier 15 is mounted to the chandelier adaptor 8 by means of multiple decorative chains 9.

Figure 9:
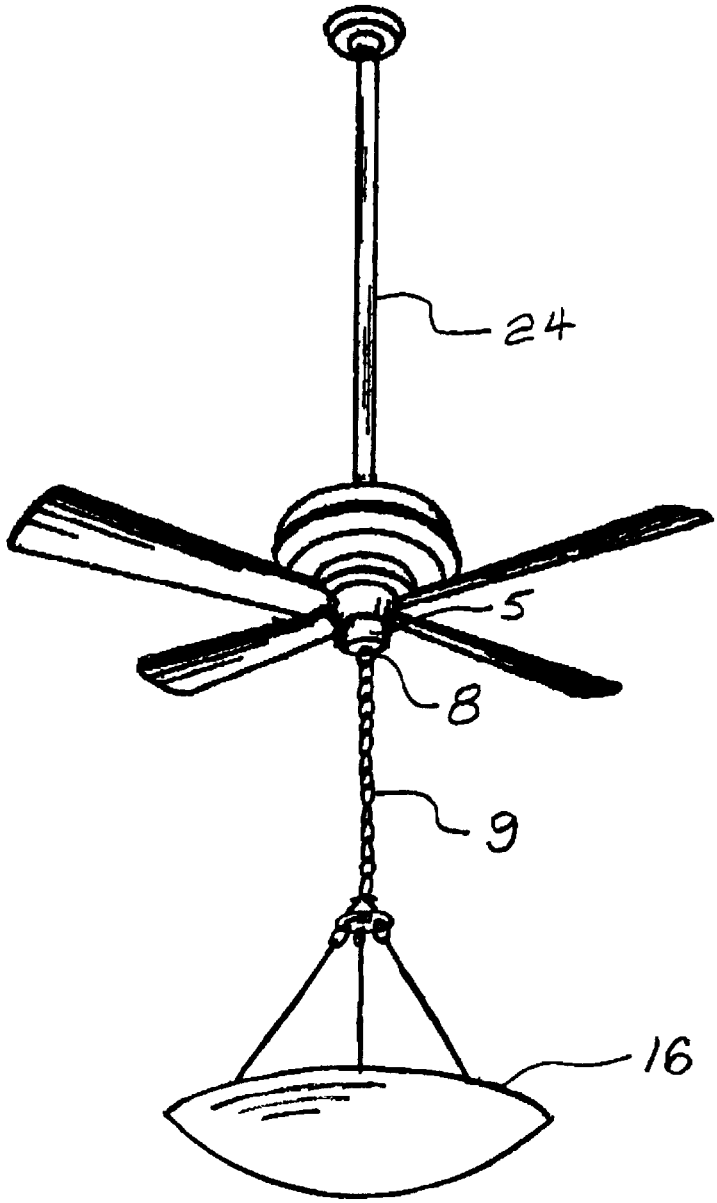
FIG. 9 shows a typical ceiling fan mounted with a ceiling rod, with the chandelier adaptor extending from the bottom of the switch housing, and a chandelier.

FIG. 9 shows a typical ceiling fan mounted to the ceiling with a rod 24. The chandelier adaptor extends out of the bottom of the switch housing 5. A pendent style chandelier 16 is mounted to the chandelier adaptor 8 by means of a decorative chain 9.

FIG. 10 is one embodiment of a one-piece chandelier adaptor (as shown in FIG. 4A). The top end has an internal thread 25 that screws onto the end of the stationary box shaft 4. The chandelier adaptor is hollow to allow the passage of the electrical wiring from the shaft 4 and from the chandelier into the switch box through cutouts 26. External threads 27 are provided to allow a nut 7 to be used to retain the switch box cover 6R (FIG. 4A). The chandelier is attached to the integral ring 28.

FIG. 11 is a further embodiment of the one-piece chandelier adaptor (as shown in FIG. 4B) that would allow multiple attachment or suspension points for a chandelier. The top end contains an internal thread 25 that screws onto the end of the stationary switch box shaft 4. The chandelier adaptor is hollow to allow the passage of the electrical wiring from the shaft 4 and from the chandelier into the switch box through cutouts 26. External threads 27 are provided to allow a nut 7 to be used to retain the switch box cover 6R'. The chandelier is attached to the integral rings 28.

Figure 12:
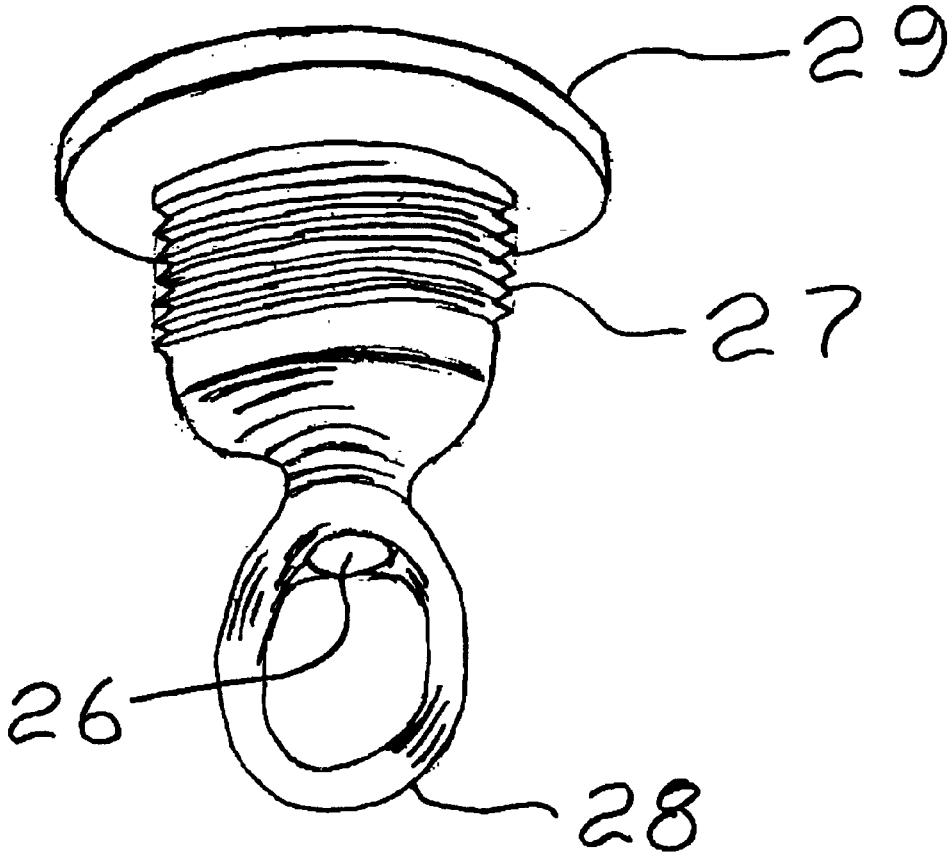
FIG. 12 is a switch box cover mounted chandelier adaptor that allows the chandelier to be mounted to the switch box cover according to the invention.

FIG. 12 is the switch box cover mounted chandelier adaptor (as shown in FIG. 5) that would allow a chandelier to be mounted to the switch box cover 6R". The top end contains a flange 29, which will retain it in the cover. The chandelier adaptor is hollow to allow the passage of the electrical wiring from the chandelier into the switch box through cutouts 26. External threads 27 are provided to allow a nut 7 to be used to retain the adaptor to the switch box cover 6. This switch box cover is mounted to the switch box by means of screws 10. The chandelier is attached to the integral ring 28.

While the invention has been described in relation to preferred embodiments of the invention, it will be appreciated that other embodiments, adaptations and modifications of the invention will be apparent to those skilled in the art.

What is claimed is:

1. A ceiling fan and a pendent chandelier wherein said pendent chandelier has an elongated suspension member, said elongated suspension member having an upper end, a lower end, and an adaptor member, said adaptor member being secured to said ceiling fan and having one or more rings at the bottom thereof and a chandelier wiring passage therethrough, said upper end of said elongated suspension member being secured to said adaptor member and said lower end of said elongated suspension member being secured to said chandelier.

2. The invention defined in claim 1 wherein said ceiling fan has a stationary axial member and said adaptor member is secured to said stationary axial member.

3. The invention defined in claim 1 wherein said adaptor is constructed in such a manner to allow the center thereof to be hollow for the passage of electrical wiring to said pendent chandelier.

4. A chandelier adaptor for adapting a ceiling fan to hang a pendent chandelier therefrom comprising a body member having an upper end adapted to be secured to a stationary portion of said ceiling fan and a lower end having one or more integral rings thereon for coupling the chandelier thereto.

5. The chandelier adaptor defined in claim 4 wherein said upper end is internally threaded for screwing onto the end of the stationary switch box mounting shaft of an existing fan.

6. The chandelier adaptor defined in claim 4 wherein said chandelier adaptor includes a replacement switch box cover adapted to be secured to an existing switch box and having an aperture for said chandelier adaptor.

7. A chandelier adaptor for adapting a ceiling fan to hang a pendent chandelier therefrom, said ceiling fan having a switch box, a switch box mounting shaft, said switch box having a cover secured thereto, said adaptor comprising a first body member having an upper end adapted to replace said switch box cover and a second body member secured to said first body member cover and having one or more integral rings thereon for coupling the chandelier thereto.

8. The chandelier adaptor defined in claim 7 wherein said upper end is adapted to be secured to the stationary switch box mounting shaft of an existing fan.

9. The chandelier adaptor defined in claim 7 including an adaptor bracket for securing said upper end to said switch box shaft.

10. A chandelier adaptor for adapting a ceiling fan to hang a pendent chandelier therefrom comprising a body member having an upper end adapted to be secured to a stationary portion of said ceiling fan, a lower end having one or more integral rings thereon for coupling the chandelier thereto and a passage therethrough for electrical wires.

11. The chandelier adaptor defined in claim 10 wherein said upper end is internally threaded for screwing onto the end of the stationary switch box mounting shaft of an existing fan.

12. The chandelier adaptor defined in claim 10 wherein said chandelier adaptor includes a replacement switch box cover adapted to be secured to an existing switch box and having an aperture for said chandelier adaptor.

13. The chandelier adaptor defined in claim 10 wherein said chandelier adaptor is mounted to the switch box of an existing fan.

* * * * *